US005438752A

United States Patent [19]

Chang

[11] Patent Number: 5,438,752

[45] Date of Patent: Aug. 8, 1995

[54] METHOD OF MAKING DOUBLE-HEAD SIGNAL CONNECTORS FOR USE IN SCSI-II/SCSI-III COMPUTER NETWORKS

[76] Inventor: Warren Chang, No. 24, Lane 20, Shuang Cherng Road, Hsintien, Taipei Hsien, Taiwan

[21] Appl. No.: 283,862

[22] Filed: Aug. 1, 1994

[51] Int. Cl.[6] ..... H01R 43/00

[52] U.S. Cl. ..... 29/857; 439/405; 439/610

[58] Field of Search ..... 439/395–405, 439/502, 505, 638, 654, 685, 686, 695, 696, 701, 607, 609, 610; 29/842, 856, 857, 858, 876, 883

[56] References Cited

U.S. PATENT DOCUMENTS

| | | | |
|---|---|---|---|
| 5,052,949 | 10/1991 | Lopata et al. | 439/610 |
| 5,118,306 | 6/1992 | Bixler et al. | 439/405 X |
| 5,119,020 | 6/1992 | Massey et al. | 439/502 X |
| 5,332,395 | 7/1994 | Wen-Yu | 439/610 X |

*Primary Examiner*—Khiem Nguyen
*Attorney, Agent, or Firm*—Lowe, Price, LeBlanc & Becker

[57] ABSTRACT

A method of making a double-head signal connector, which includes the steps of: i) preparing a signal line distribution plate; ii) inserting the leading ends of the pairs of signal lines of a Transmission Data Bus Line through an elongated center slot on the signal line distribution plate and then turning them backwards from the top and the bottom respectively; iii) preparing a holding down plate; iv) fastening the holding down plate to the signal line distribution plate to hold down the distributed signal lines; v) preparing a female header; fastening the female header to the holding down plate permitting the contacts of the female header to make a respective contact with the conductors of signal lines; vii) preparing a male header; viii) fastening the leading ends of the signal lines to the forked tails of the contacts of the male header permitting the contacts of the male header to make a respective electric contact with the signal lines; ix) fastening two fastening plates to the male header to hold down the leading ends of the signal lines; x) covering a layer of insulative material over the signal lines between the male and female headers; xi) covering a layer of shielding metal over the layer of insulative material to protect against outside magnetic waves; and xii) fastening the cover shell.

1 Claim, 8 Drawing Sheets

METHOD OF MAKING DOUBLE-HEAD SIGNAL CONNECTORS FOR USE IN SCSI-II/SCSI-III COMPUTER NETWORKS

BACKGROUND OF THE INVENTION

The present invention relates to a method of using regular signal-head signal connector elements to make double-head signal connectors for use in SCSI-II/SCSI-III computer networks.

AMPLIMITE Series Busing Connectors (manufactured by American AMP Company), as illustrated in FIGS. 1 and 2, are intensively used in SCSI-II/SCSI-III computer networks for the advantage of that high transmission efficiency without low signal loss. These connectors are patented products and their supply is completely controlled by the patent owner or its authorized manufacturers. Because only few manufacturing plants are authorized to manufacture these connectors, the supply of these connectors is unstable. Another drawback of these connectors is their complicated manufacturing process, and therefore their manufacturing cost is high.

SUMMARY OF THE INVENTION

The present invention has been accomplished under the circumstances in view. It is therefore one object of the present invention to provide a signal connector which is functional for use in SCSI-II/SCSI-III computer networks. It is another object of the present invention to provide a signal connector for use in SCSI-II/SCSI-III computer networks which is easy and inexpensive to manufacture. It is still another object of the present invention to provide a signal connector for use in SCSI-II/SCSI-III computer networks which improves signal transmission stability.

According to the present invention, the method includes the steps of: i) preparing a signal line distribution plate; ii) inserting the leading ends of the pairs of signal lines of a Transmission Data Bus Line through an elongated center slot on the signal line distribution plate and then turning them backwards from the top and the bottom respectively; iii) preparing a holding down plate; iv) fastening the holding down plate to the signal line distribution plate to hold down the distributed signal lines; v) preparing a female header; fastening the female header to the holding down plate permitting the contacts of the female header to make a respective contact with the conductors of signal lines; vii) preparing a male header; viii) fastening the leading ends of the signal lines to the forked tails of the contacts of the male header permitting the contacts of the male header to make a respective electric contact with the signal lines; ix) fastening two fastening plates to the male header to hold down the leading ends of the signal lines; x) covering a layer of insulative material over the signal lines between the male and female headers; xi) covering a layer of shielding metal over the layer of insulative material to protect against outside magnetic waves; and xii) fastening the cover shell.

DETAILED DESCRIPTION OF THE PREFERRED EMBODIMENT

Various materials are prepared before starting the production process. These materials include pair of signal lines respectively coded by different colors or serial numbers, shielding metal meshes, insulative packing plastics, outer sealing shells or coating materials, headers, etc. When all necessary materials are prepared, the production process can then be proceeded.

Figure 1:
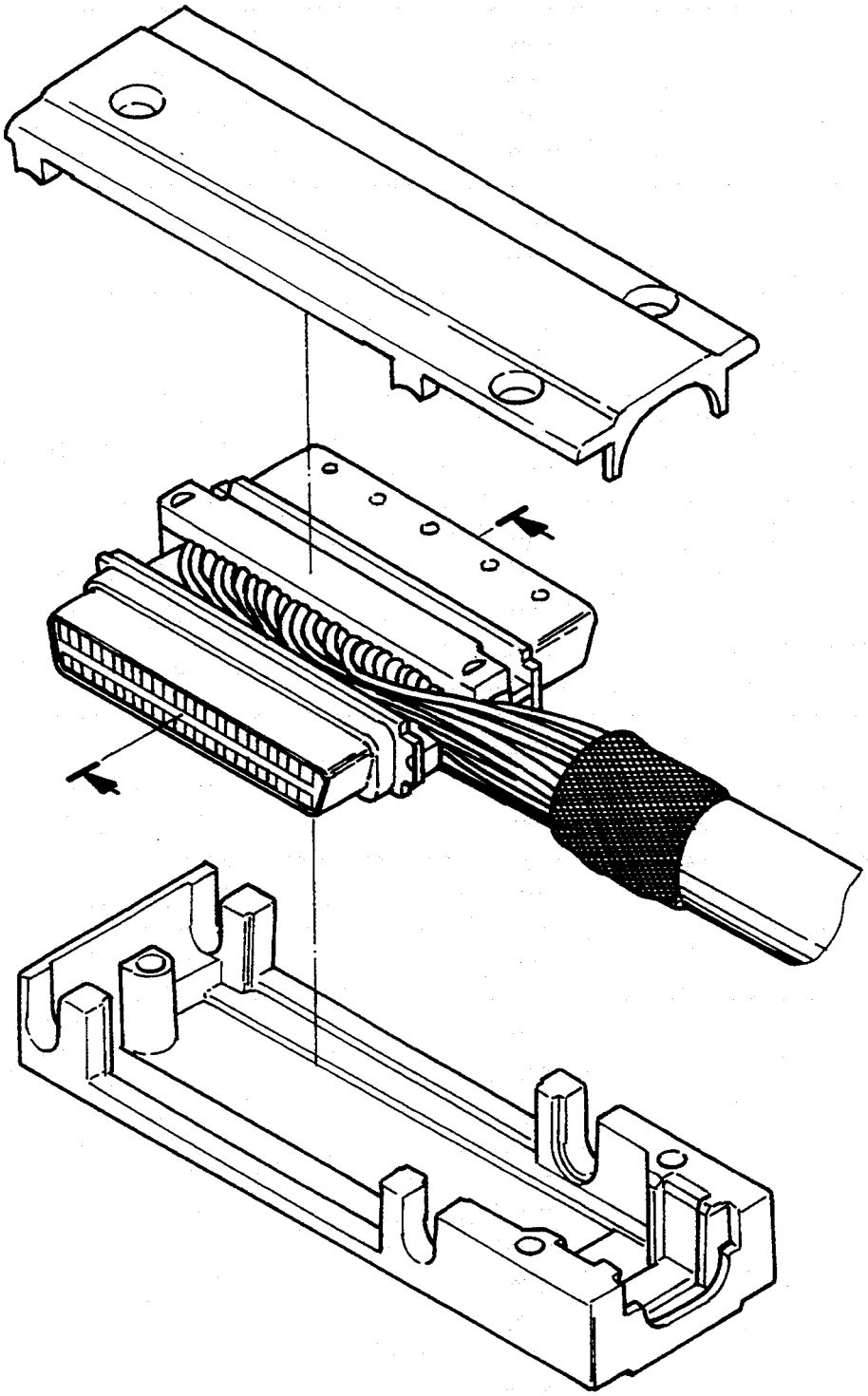
FIG. 1 (PRIOR ART)
FIG. 1 is a dismantled view of a double-head signal connector made by AMPLIMITE.
Figure 2:
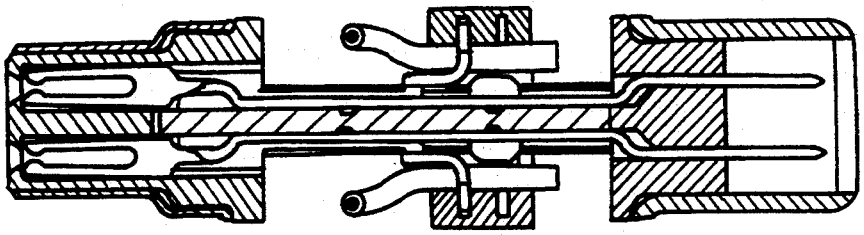
FIG. 2 (PRIOR ART)
FIG. 2 is a sectional view of the double-head signal connector shown in FIG. 1.
Figure 3:
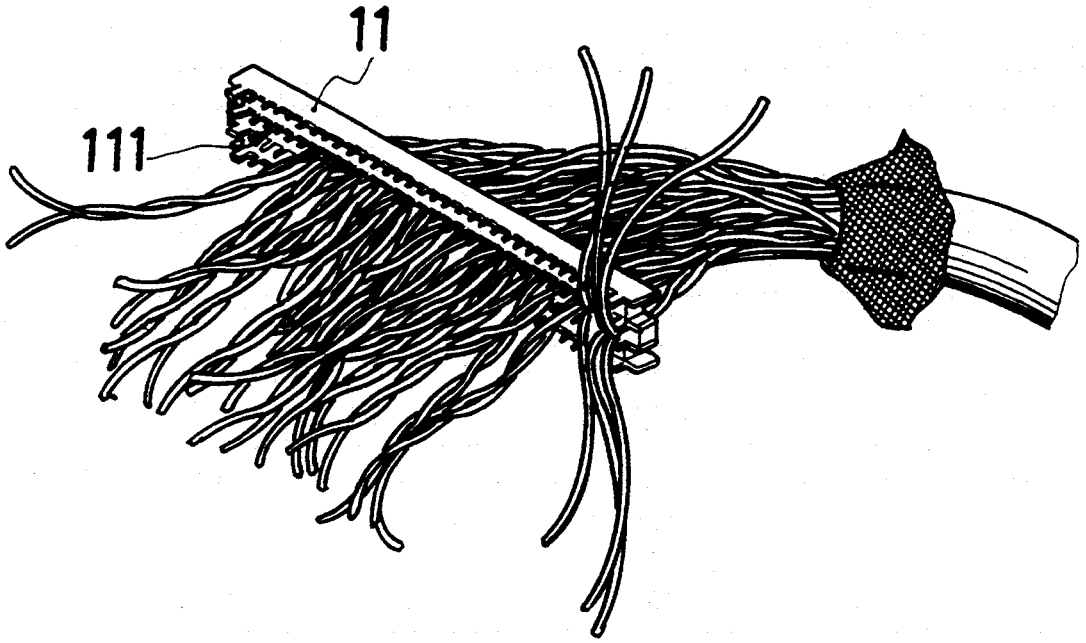
FIG. 3 shows pairs of signal lines inserted through elongated center slot of a signal line distribution plate and distributed properly according to the present invention.

Referring to FIG. 3, a signal line distribution plate 11 is provided, having an elongated center slot 111 longitudinally disposed in the middle and pairs of retaining grooves 111, 112, 113 and 114 symmetrically disposed at two opposite ends. The pairs of signal lines from the Transmission Data Bus Line are inserted through the elongated center slot 111 from the back and then turned backwards from both sides in proper order according to their coded colors or serial numbers.

Figure 4:
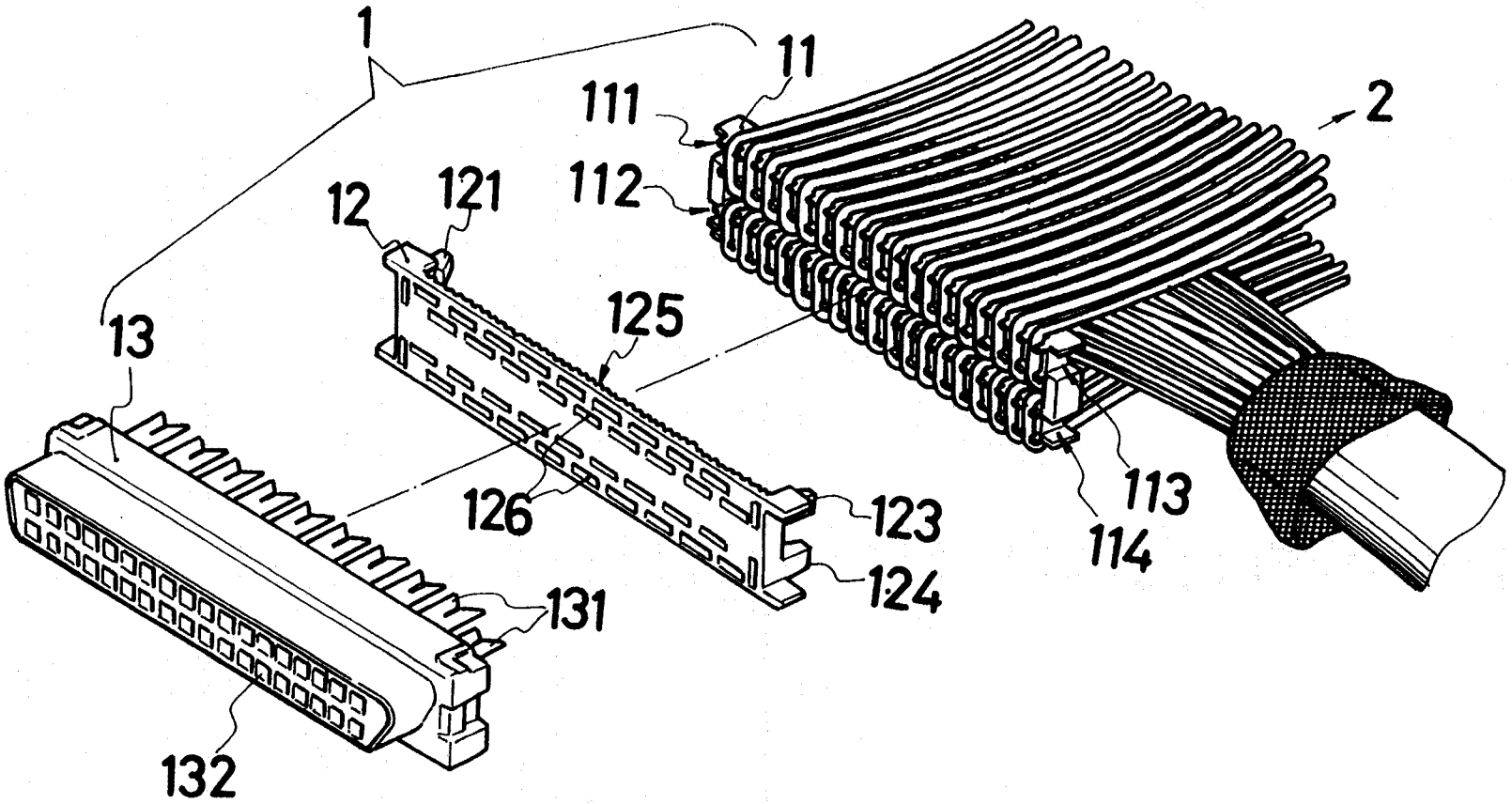
FIG. 4 shows the pairs of signal lines well distributed through the signal line distribution plate for mounting with a holding down plate and a female header.

Referring to FIG. 4, a holding down plate 12 is provided, having serrated portions 125 longitudinally disposed on the back side thereof for holding down the signal lines on the signal line distribution plate 11, two parallel rows of slots 126 through the thickness, and pairs of retaining rods 121, 122, 123 and 124 perpendicularly extended from the opposite ends of the back side thereof. By fitting the retaining rods 121, 122, 123 and 124 into the retaining grooves 111, 112, 113 and 114, the holding down plate 12 is fastened to the signal line distribution plate 11 to hold down the pairs of signal lines. A female header 13 is provided having two longitudinal rows of slots 132 for receiving the contact pins of a matching signal connector, two rows of contacts 131 respectively extended out of the slots 132 from the back. By inserting the rows of contacts 132 into the slots 126 on the holding down plate 12, the female header 13 is fastened to the holding down plate 1 and the signal line distribution plate 11, and therefore the female header 13 and the holding down plate 12 and the signal line distribution plate 11 are fastened together and form a female connector 1. When the contacts 131 of the female header 13 are respectively inserted into the slots 126 on the holding down plate 12, the sharp edges of the contacts 131 pierce the insulators of the pairs of signal lines on the signal line distribution plate 11 to make a respective electric contact.

Figure 5:
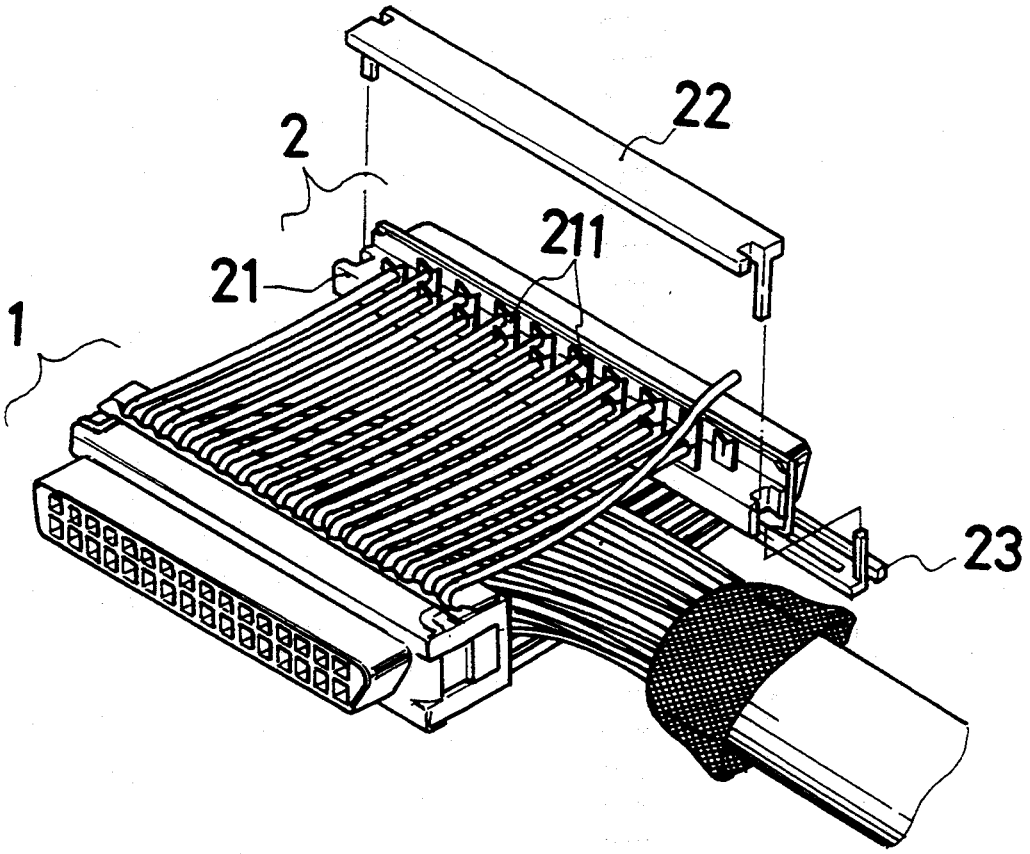
FIG. 5 shows the signal lines of the female connector of FIG. 4 respectively connected to a male header.
Figure 6:
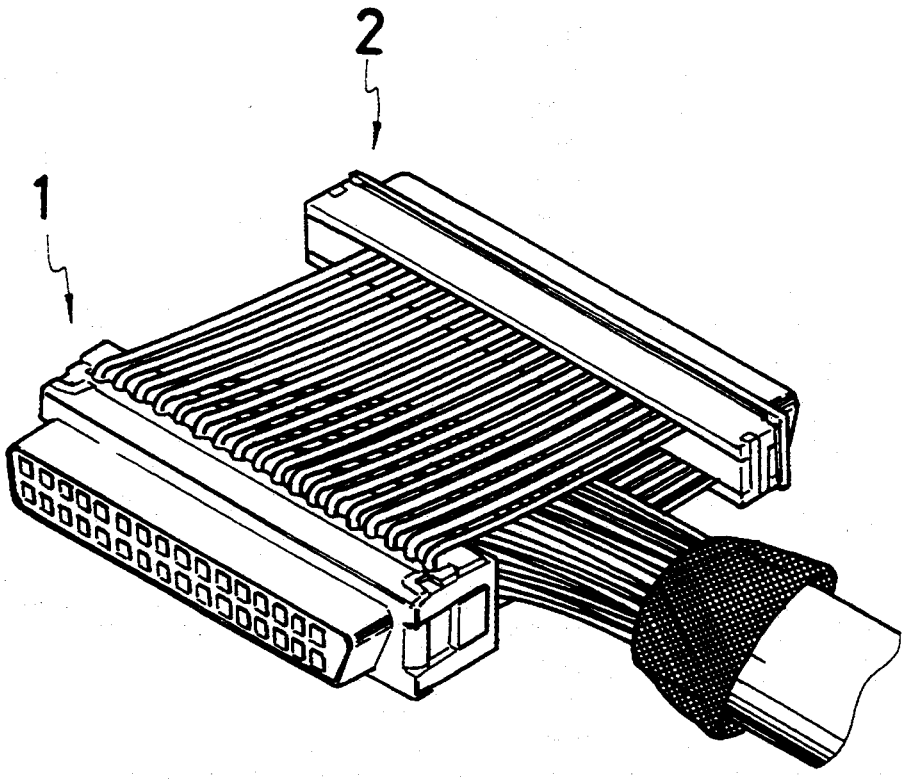
FIG. 6 shows two fastening plates fastened to the male header of FIG. 5 and connected together.

Referring to FIGS. 5 and 6, a male header 21 is provided having parallel rows of contacts with forked tails 211. The distributed signal lines from the female connector 1 are respectively fastened to the forked tails 211 of the contacts of the male header 21 by means of a crimper, permitting the forked tails 211 of the contacts of the male header 21 to pierce the insulators of the signal lines and to make a respective electric contact. When connected, two matched fastening plates 22 and 23 are fastened together to hold down the signal lines and the male header 21. Therefore, the male header 21, the fastening plates 22 and 23 and the signal lines are connected together and form a male connector 2.

Figure 7:
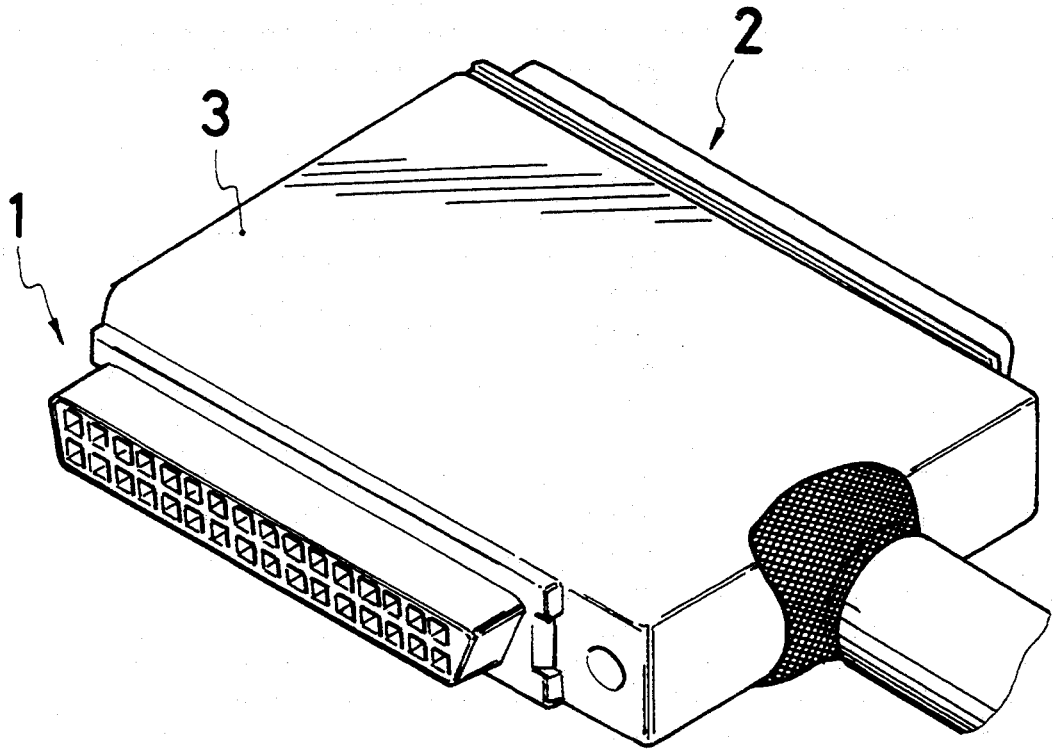
FIG. 7 shows a plastic film covered on the signal lines between the female and male connectors of FIG. 6.
Figure 8:
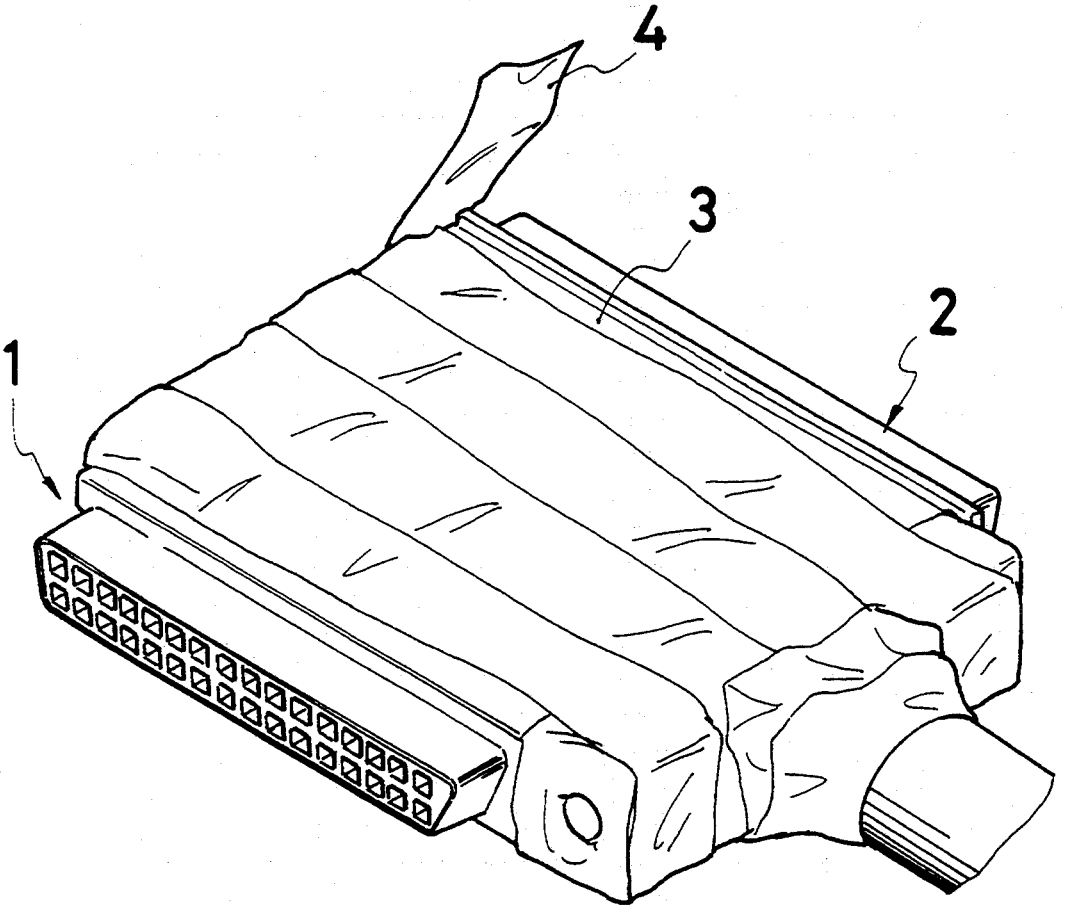
FIG. 8 shows a shielding metal mesh covered on the plastic film of FIG. 7.
Figure 9:
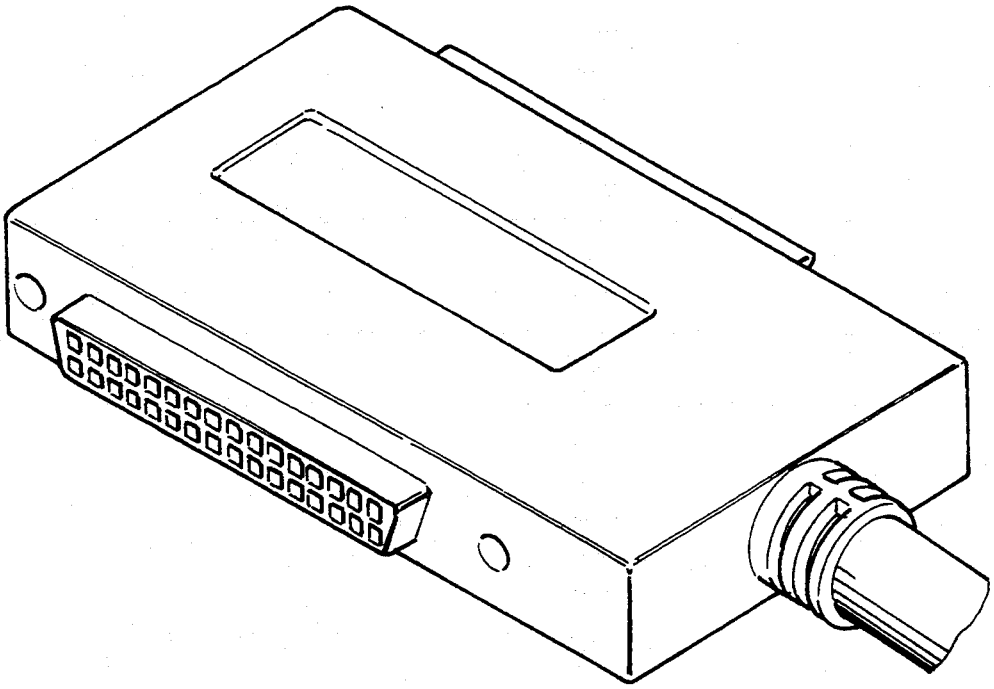
FIG. 9 shows a finished double-head signal connector made according to the present invention.

Referring to FIGS. 7, 8, and 9, after the assembly of the female connector 1 and the male connector 2, the procedures of magnetic wave shielding and water proofing are then proceeded. A plastic film (such as polyethylene film) 3 is covered around the signal lines between the female connector 1 and the male connector 2 to seal against moisture. A metal shielding mesh (or copper foil as shown in FIG. 8) 4 is then covered over the plastic film 3 to protect against external magnetic interference. After the mounting of the metal shielding mesh, an insulative cover shell (of polyvinyl chloride) is fastened to the female and male connectors 1 and 2 and covered over the metal shielding mesh 4. If a metal cover shell is used and covered over the metal shielding mesh 4, the metal shielding mesh 4 must be protected against interfering noises from the metal cover shell.

According to tests, a signal connector made according to the aforesaid process provides same signal transmission capability as commercially available AMPLIMITE Series Busing Connectors.

What is claimed is:

1. A method of making a double-head signal connector for use in SCSI-II/SCSI-III computer network, comprising the steps of:

i) preparing a signal line distribution plate having an elongated center slot longitudinally disposed in the middle and pairs of retaining grooves symmetrically disposed at two opposite ends;

ii) inserting the leading ends of the pairs of signal lines of a Transmission Data Bus Line through the elongated center slot of said signal line distribution plate from the back, then dividing the signal lines into two rows according to their colors or coded serial numbers, and then turning the two rows of signal lines backwards over the top or bottom side of the signal line distribution plate;

iii) preparing a holding down plate having serrated portions at the back for holding down the signal lines on said signal line distribution plate, two parallel rows of slots longitudinally aligned, and pairs of retaining rods perpendicularly extended two opposite ends thereof at the back;

iv) fastening said holding down plate by fitting said retaining rods into said retaining grooves, permitting the signal lines to be retained in place by the serrated portions of said holding down plate;

v) preparing a female header having two longitudinal rows of slots for receiving the contact pins of a matching signal connector, two rows of contacts with sharp edges respectively extended out of the slots thereof from the back;

vi) fastening said female header to said holding down plate and said signal line distribution plate by inserting the rows of contacts of said female header into the slots on on said holding down plate permitting the sharp edges of the contacts of said female header to pierce the insulators of the signal lines and to make a respective electric contact;

vii) preparing a male header having parallel rows of contacts with forked tails;

viii) fastening the leading ends of the signal lines to the forked tails of the contacts of said male header permitting the forked tails of the contact of said male header to pierce the insulators of the signal lines and to make a respective electric contact;

ix) fastening two fastening plates to said male header permitting the leading ends of the signal lines to be held connected to the contacts of said male header by said fastening plates;

x) covering a layer of insulative material over the signal lines between said female header and said male header to seal out moisture;

xi) covering a layer of shielding metal over the layer of insulative material to protect against the interference of external magnetic noises; and xii) fastening a cover shell to said female and male header and covering it over the layer of shielding metal permitting the Transmission Data Bus Line to extend out of said cover shell.

* * * * *